US008998057B2

(12) United States Patent
Gathers

(10) Patent No.: US 8,998,057 B2
(45) Date of Patent: Apr. 7, 2015

(54) HOOK ASSEMBLY FOR USE WITH A POWER TOOL

(75) Inventor: Adam Gathers, Anderson, SC (US)

(73) Assignee: Techtronic Power Tools Technology Limited, Tortola (VG)

( * ) Notice: Subject to any disclaimer, the term of this patent is extended or adjusted under 35 U.S.C. 154(b) by 429 days.

(21) Appl. No.: 13/213,497

(22) Filed: Aug. 19, 2011

(65) Prior Publication Data

US 2013/0043295 A1 Feb. 21, 2013

(51) Int. Cl.

*B25C 7/00* (2006.01)
*B25F 5/02* (2006.01)
*A45F 5/02* (2006.01)

(52) U.S. Cl.

CPC . *B25F 5/02* (2013.01); *A45F 5/021* (2013.01); *A45F 2005/028* (2013.01); *A45F 2200/0575* (2013.01)

(58) Field of Classification Search

CPC ..... B25C 1/04; A45F 5/00; F16M 11/00
USPC ..... 227/130, 131, 134; 173/170, 171; 224/269; 24/3.12, 336
See application file for complete search history.

(56) References Cited

U.S. PATENT DOCUMENTS 1,534,879 A * 4/1925 Stewart ..... 294/82.23
5,180,091 A 1/1993 Ota
5,255,402 A * 10/1993 Kashani ..... 4/679
5,265,312 A 11/1993 Okumura
5,676,285 A 10/1997 Vinarsky
5,697,127 A * 12/1997 Tyler ..... 24/3.7
5,816,461 A * 10/1998 Balcom ..... 224/269
6,230,367 B1 5/2001 Riedl
6,352,235 B2 3/2002 Cizek
6,612,476 B2 9/2003 Smolinski
7,111,364 B2 9/2006 Bader et al.
7,222,767 B1 5/2007 Yang
7,225,959 B2 6/2007 Patton et al.
7,306,052 B2 12/2007 Vahabi-Nejad et al.
7,318,487 B2 1/2008 Liao
7,320,422 B2 1/2008 Schell et al.
7,322,506 B2 1/2008 Forster
7,565,989 B2 7/2009 Lai et al.
7,942,299 B2 * 5/2011 Steinbrunner et al. ..... 227/156
2005/0133393 A1 6/2005 Lawrence et al.
2005/0133552 A1 6/2005 Lawrence
2006/0091168 A1 5/2006 Ng
2006/0104735 A1 5/2006 Zeiler et al.
2007/0080278 A1 4/2007 Wen
2007/0277990 A1 12/2007 Steinbrunner et al.
2008/0023518 A1 1/2008 Wojcicki
2008/0023520 A1 * 1/2008 Marshall et al. ..... 227/130
2008/0135598 A1 6/2008 Burke et al.
2008/0277939 A1 * 11/2008 Richardson et al. ..... 290/50
2009/0277939 A1 11/2009 Ou
2009/0278012 A1 11/2009 Okouchi et al.

* cited by examiner

*Primary Examiner* — Nathaniel Chukwurah
(74) *Attorney, Agent, or Firm* — Michael Best & Friedrich LLP

(57) ABSTRACT

A hook assembly includes an end cap having an outer periphery. The end cap is configured to be connected to a power tool. A hook is rotatably coupled to the outer periphery of the end cap. An O-ring is positioned between the outer periphery of the end cap and the hook. A protrusion is included on one of the outer periphery of the end cap and the hook to frictionally engage the O-ring to secure the hook in at least one selected rotational position relative to the end cap.

22 Claims, 4 Drawing Sheets

HOOK ASSEMBLY FOR USE WITH A POWER TOOL

FIELD OF THE INVENTION

The present invention relates to power tools, and more particularly to a hook assembly for a power tool.

BACKGROUND OF THE INVENTION

Hook assemblies are typically used to support a tool on a tool belt. Some hook assemblies are typically fixed to the tool such that the hook cannot be repositioned relative to the tool. Other hook assemblies are adjustable relative to the tool in two or more discrete positions using a detent arrangement.

SUMMARY OF THE INVENTION

The invention provides, in one aspect, a hook assembly including an end cap having an outer periphery. The end cap is configured to be connected to the power tool. A hook is rotatably coupled to the outer periphery of the end cap. An O-ring is positioned between the outer periphery of the end cap and the hook. A protrusion on one of the outer periphery of the end cap and the hook frictionally engages the O-ring to secure the hook in at least one selected rotational position relative to the end cap.

The invention provides, in another aspect, a pneumatic nailer including a body in which pressurized air is maintained for actuating the pneumatic nailer. An end cap including an outer periphery is coupled to the body. An inlet is defined in the end cap through which the pressurized air is introduced into the body when the body is communicated with a source of pressurized air. A hook is rotatably coupled to the outer periphery of the end cap. An O-ring is positioned between the outer periphery of the end cap and the hook. A protrusion on one of the outer periphery of the end cap and the hook frictionally engages the O-ring to secure the hook in at least one selected rotational position relative to the end cap.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
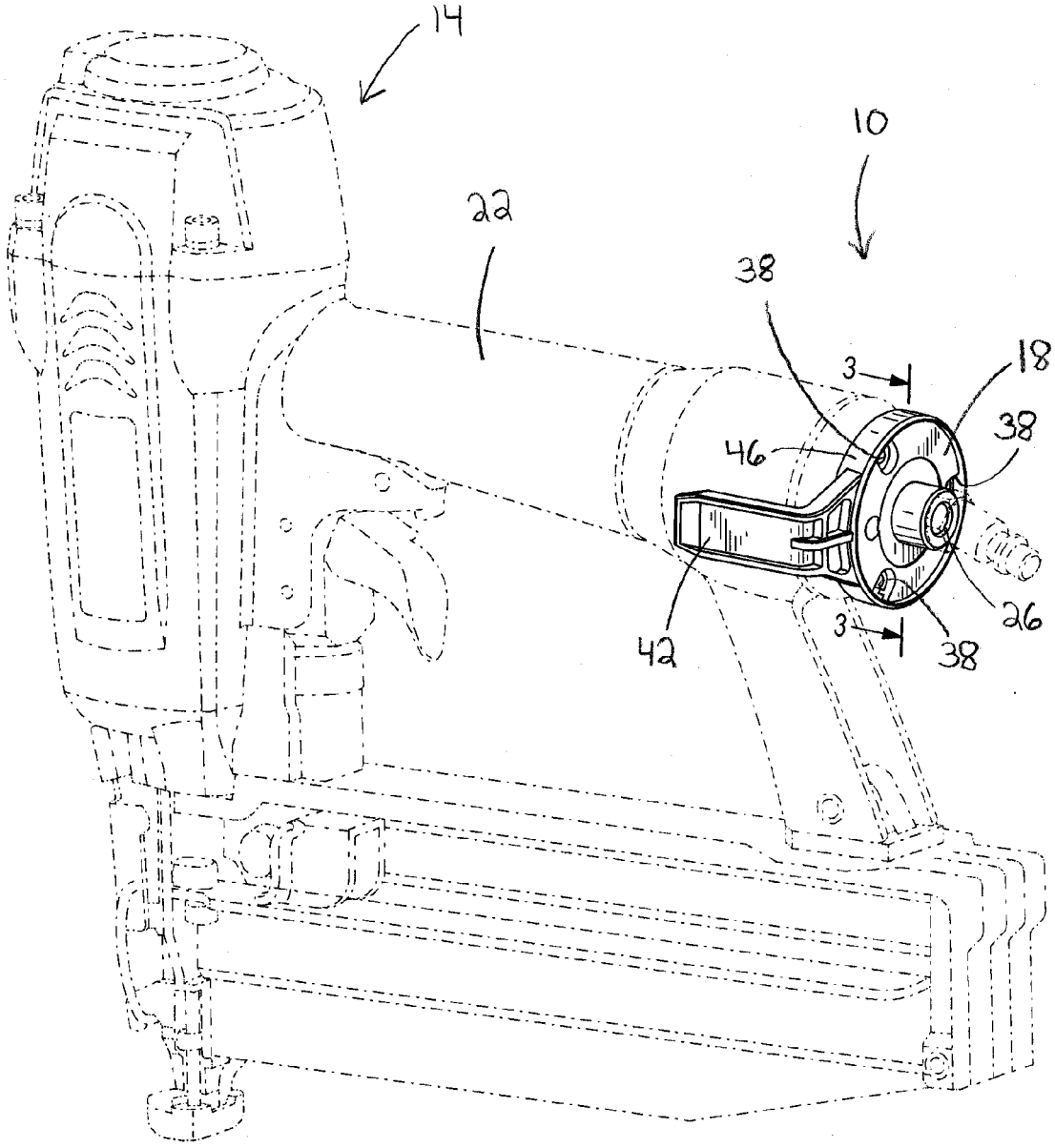
FIG. 1 is a perspective view of a power tool hook assembly of the invention.
Figure 2:
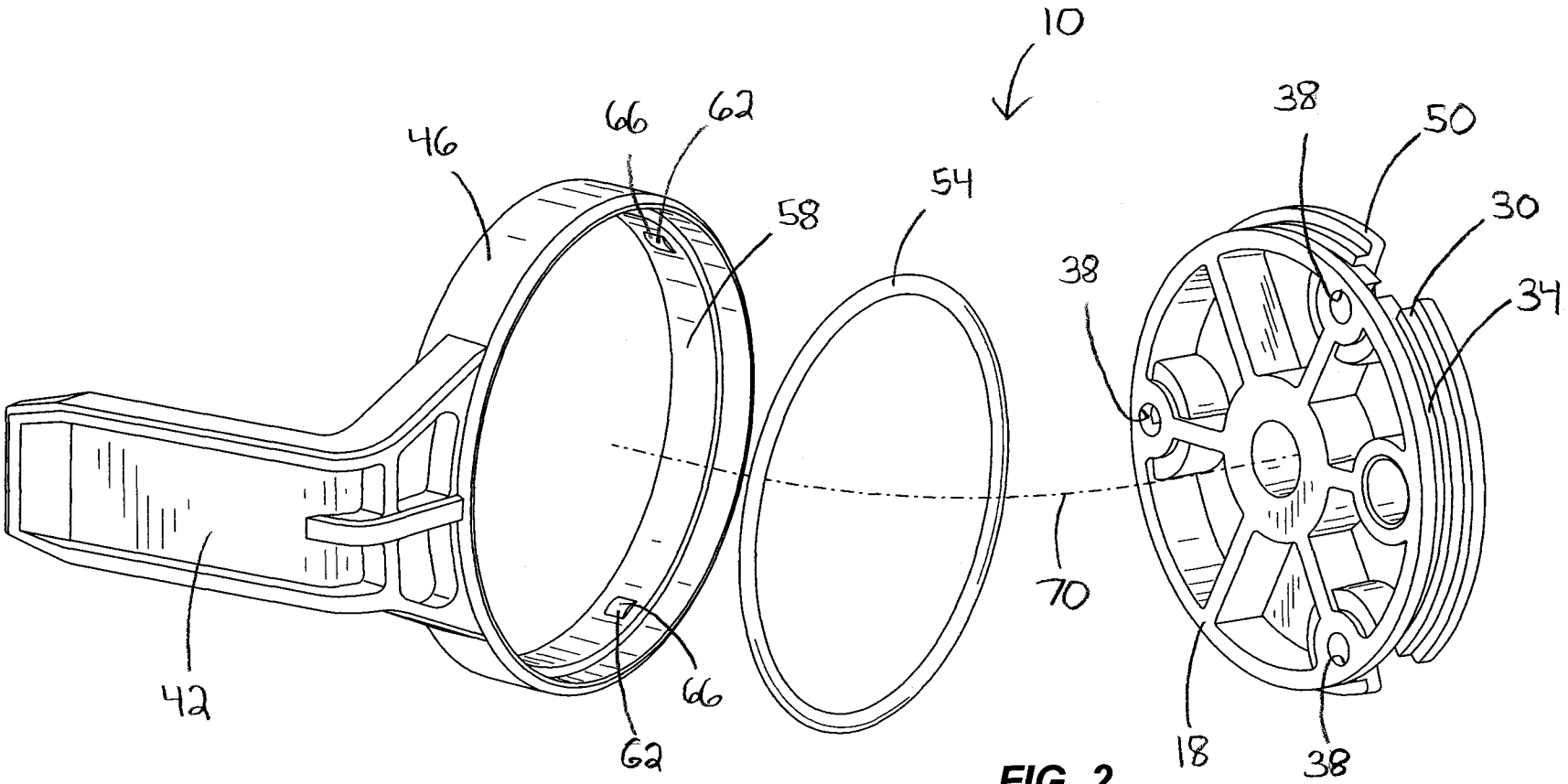
FIG. 2 is an exploded perspective view of an end cap, an O-ring, and a hook of the hook assembly of FIG. 1.

FIGS. 1 and 2 illustrate a hook assembly 10 for use with a power tool 14 to support the power tool 14 on a user's tool belt or another support surface. In the illustrated construction, the power tool 14 is configured as a pneumatic finish nailer, but could be any pneumatic or electric power tool (e.g., a drill, etc.). The hook assembly 10 includes an end cap 18 coupled to a handle 22 of the power tool 14 (FIG. 1). In the illustrated construction, the end cap 18 includes an air inlet port 26 through which compressed air is delivered to the tool 14 to operate the tool 14. Alternatively, when the hook assembly 10 is utilized with an electric tool, the air inlet port 26 may be omitted. With reference to FIG. 2, the end cap 18 includes a circumferential outer periphery 30, a circumferential groove 34 in the outer periphery 30, and apertures 38, three in the illustrated construction, for receiving fasteners (not shown) to connect the end cap 18 to the handle 22 of the power tool 14. Alternatively, the end cap 18 may include any number of apertures 38 according to the particular configuration of the power tool 14 and/or hook assembly 10. As a further alternative, a different attachment mechanism may be used to attach the end cap 18 to the power tool 14 (e.g., a snap feature, etc.).

The hook assembly 10 also includes a hook 42 having an annular body 46 that is rotatably coupled to the outer periphery 30 of the end cap 18. The annular body 46 of the hook 42 is axially secured relative to the power tool 14 on one side by the handle 22 and on the other side by a flange 50 on the end cap 18.

Figure 3:
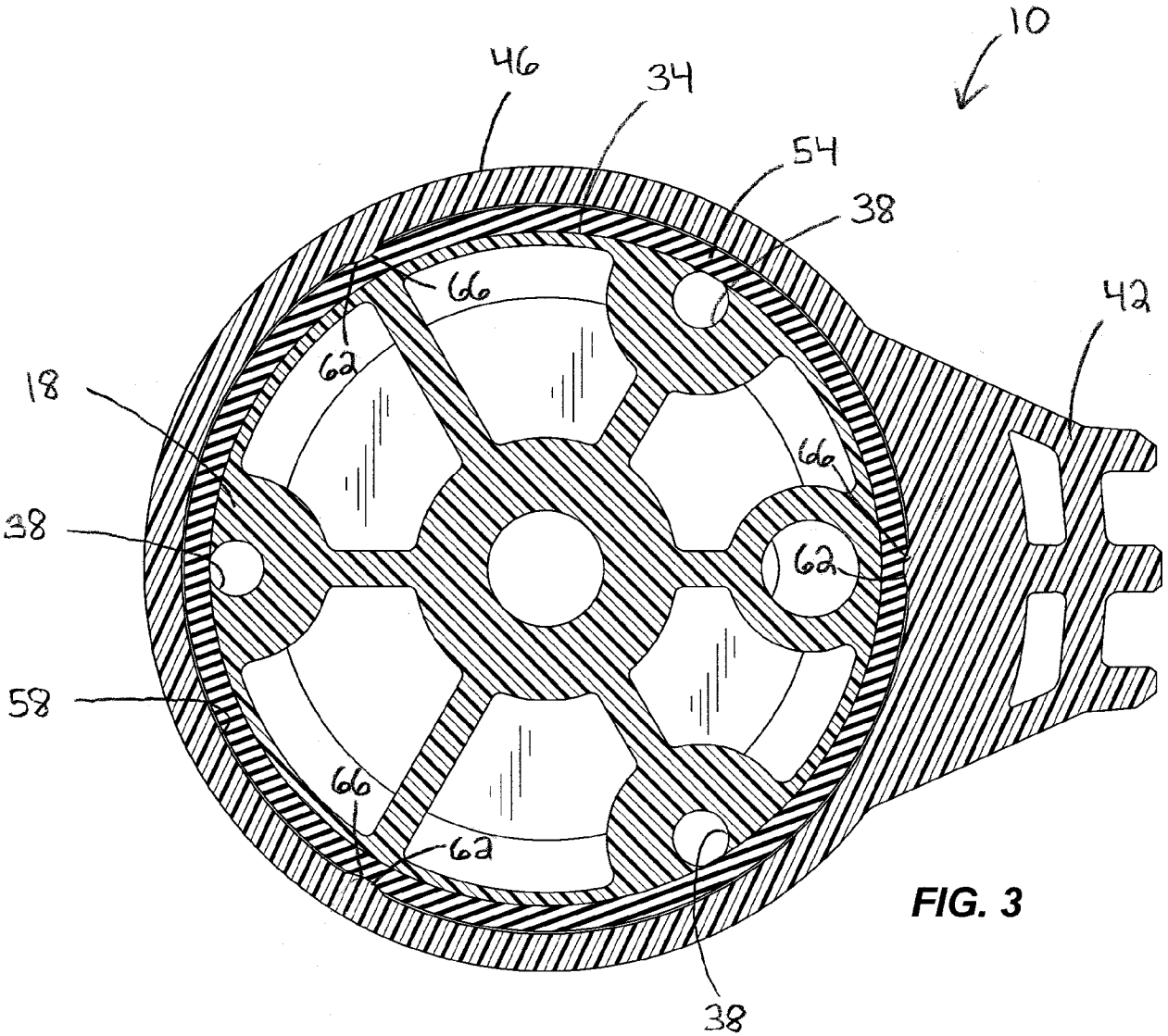
FIG. 3 is a cross-sectional view of the hook assembly of FIG. 1, taken along line 3-3 in FIG. 1.
Figure 4:
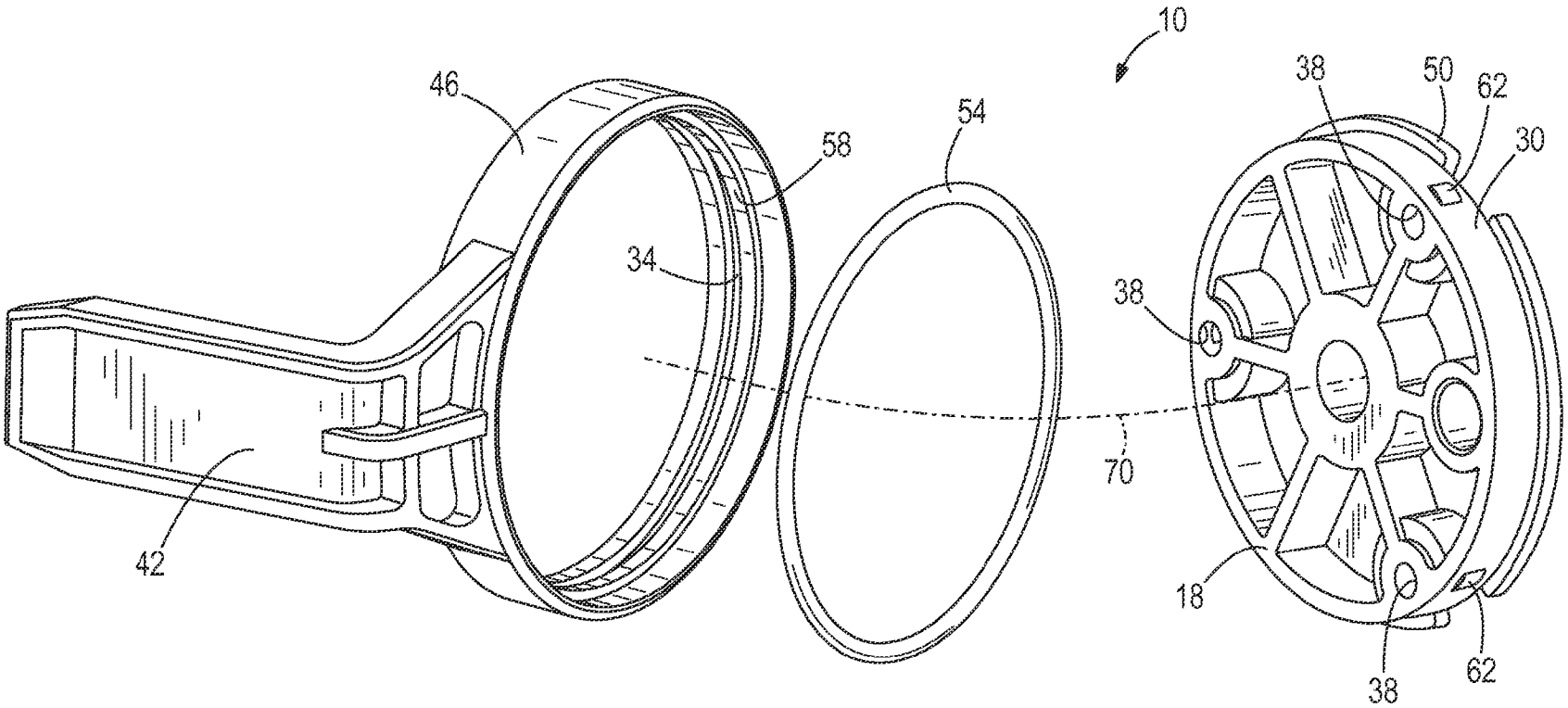
FIG. 4 is an exploded perspective view of a hook assembly in accordance with another embodiment of the invention.

With reference to FIGS. 2 and 3, an O-ring 54 is positioned in the circumferential groove 34 of the end cap 18. In the illustrated construction of the hook assembly 10, an inner peripheral surface 58 of the annular body 46 includes three radially inwardly extending protrusions 62, each having an arcuate surface 66, that compress and frictionally engage the O-ring 54 to secure the hook 42 in at least one selected rotational position relative to the end cap 18. The protrusions 62 also coaxially align the annular body 46 with a central axis 70 of the end cap 18. In the illustrated construction, the protrusions 62 are equally spaced from each other by about 120 degrees. Alternatively, the three protrusions 62 may have a different angular spacing from each other. Furthermore, fewer or more than three protrusions 62 may be included on the annular body 46. As a further alternative, the protrusions 62 may be included on the outer periphery 30 of the end cap 18, and the groove 34 may be included in the inner peripheral surface 58 of the annular body 46 with the O-ring 54 disposed in the groove 34 (FIG. 4).

In operation of the hook assembly 10, the protrusions 62 compress the O-ring 54 and provide a frictional force between the end cap 18 and the hook 42 to maintain the position of the hook 42 with respect to the end cap 18. The hook 42 may be rotated in response to the user imparting a torque on the hook 42 sufficient to overcome the frictional force between the hook 42 and the O-ring 54. The hook 42 may be rotated between different rotational positions to orient the hook 42 at any desired angle or position with respect to the end cap 18. After adjustment of the hook 42, the frictional force between the protrusions 62 and the O-ring 54 is sufficient to maintain the orientation of the hook 42 with respect to the end cap 18 while the power tool 14 is being supported on the user's tool belt or another support surface. Advantageously, the desired angle or position of the hook 42 relative to the end cap 18 is not pre-defined by a detent arrangement. As such, the hook 42 may be oriented relative to the end cap 18 without being limited to a discrete number of pre-defined positions, thereby providing a greater range of adjustment compared to conventional power tool hook assemblies.

Various features and advantages of the invention are set forth in the following claims. claims.

What is claimed is:

1. A hook assembly for use with a power tool, the hook assembly comprising:

an end cap including an outer periphery, the end cap configured to be connected to the power tool;

a hook rotatably coupled to the outer periphery of the end cap;

an O-ring positioned between the outer periphery of the end cap and the hook; and a protrusion on one of the outer periphery of the end cap and the hook for sliding frictional contact with the O-ring in response to relative rotation between the hook and the end cap to secure the hook in at least one selected rotational position relative to the end cap.

2. The hook assembly of claim 1, wherein the end cap includes a circumferential groove in the outer periphery, and wherein the O-ring is at least partially received in the groove.

3. The hook assembly of claim 2, wherein the hook includes a substantially annular body having an inner peripheral surface, and wherein the protrusion extends radially inwardly from the inner peripheral surface to frictionally engage the O-ring.

4. The hook assembly of claim 3, wherein the protrusion is one of three radially inwardly extending protrusions on the hook.

5. The hook assembly of claim 4, wherein the end cap includes a central axis, and wherein the three protrusions coaxially align the annular body with the central axis.

6. The hook assembly of claim 4, wherein the three radially inwardly extending protrusions are equally spaced from each other by about 120 degrees.

7. The hook assembly of claim 1, wherein the protrusion compresses the O-ring and provides a frictional force between the end cap and the hook.

8. The hook assembly of claim 7, wherein the hook is rotatable to another rotational position relative to the end cap in response to an application of torque to the hook sufficient to overcome the frictional force.

9. The hook assembly of claim 1, wherein the protrusion includes an arcuate surface frictionally engaged with the O-ring.

10. The hook assembly of claim 1, wherein the at least one selected rotational position is not pre-defined relative to any one of the end cap, the hook, and the O-ring.

11. The hook assembly of claim 1, wherein the protrusion is in facing relationship with the O-ring.

12. A pneumatic nailer comprising:

a body in which pressurized air is maintained for actuating the pneumatic nailer;

an end cap including an outer periphery, the end cap coupled to the body;

an inlet defined in the end cap through which the pressurized air is introduced into the body when the body is communicated with a source of pressurized air;

a hook rotatably coupled to the outer periphery of the end cap;

an O-ring positioned between the outer periphery of the end cap and the hook; and a protrusion on one of the outer periphery of the end cap and the hook for sliding frictional contact with the O-ring in response to relative rotation between the hook and the end cap to secure the hook in at least one selected rotational position relative to the end cap.

13. The pneumatic nailer of claim 12, wherein the end cap includes a circumferential groove in the outer periphery, and wherein the O-ring is at least partially received in the groove.

14. The pneumatic nailer of claim 13, wherein the hook includes a substantially annular body having an inner peripheral surface, and wherein the protrusion extends radially inwardly from the inner peripheral surface to frictionally engage the O-ring.

15. The pneumatic nailer of claim 14, wherein the protrusion is one of three radially inwardly extending protrusions on the hook.

16. The pneumatic nailer of claim 15, wherein the end cap includes a central axis, and wherein the three protrusions coaxially align the annular body with the central axis.

17. The pneumatic nailer of claim 15, wherein the three radially inwardly extending protrusions are equally spaced from each other by about 120 degrees.

18. The pneumatic nailer of claim 12, wherein the protrusion compresses the O-ring and provides a frictional force between the end cap and the hook.

19. The pneumatic nailer of claim 18, wherein the hook is rotatable to another rotational position relative to the end cap in response to an application of torque to the hook sufficient to overcome the frictional force.

20. The pneumatic nailer of claim 12, wherein the protrusion includes an arcuate surface frictionally engaged with the O-ring.

21. The pneumatic nailer of claim 12, wherein the at least one selected rotational position is not pre-defined relative to any one of the end cap, the hook, and the O-ring.

22. The pneumatic nailer of claim 12, wherein the protrusion is in facing relationship with the O-ring.

* * * * *